US005643376A

United States Patent [19]

Gerhardt et al.

[11] Patent Number: 5,643,376

[45] Date of Patent: Jul. 1, 1997

[54] PREHEATING PARTICLES IN MANUFACTURE OF PRESSED BOARD

[75] Inventors: Klaus Gerhardt, Rheurdt; Armin Rapp, Kempen; Michael Schöler, Rheurdt; Hans-Dietrich Sitzler, Nettetal-Hinsbeck, all of Germany

[73] Assignee: G. Siempelkamp GmbH & Co., Krefeld, Germany

[21] Appl. No.: 498,521

[22] Filed: Jul. 5, 1995

[30] Foreign Application Priority Data

Jul. 6, 1994 [DE] Germany ..... 44 23 632.8

[51] Int. Cl.[6] ..... B27N 1/00; B27N 3/10

[52] U.S. Cl. ..... 156/62.2; 156/296; 264/109; 264/DIG. 65

[58] Field of Search ..... 156/62.2, 296; 264/109, 123, DIG. 65

[56] References Cited

U.S. PATENT DOCUMENTS 4,060,580 11/1977 Pampel .

5,063,010 11/1991 Fisher et al. .

FOREIGN PATENT DOCUMENTS 1276912 4/1969 Germany .

3640682 6/1988 Germany .

*Primary Examiner*—Michael W. Ball

*Assistant Examiner*—Sam Chuan Yao

*Attorney, Agent, or Firm*—Herbert Dubno; Andrew Wilford

[57] ABSTRACT

A particle mat for pressing into a pressed board is heated by concurrently passing through the mat treatment air coming from an air-conditioning system and having a predetermined moisture content and dew point, heating the treatment air passing through the mat to a temperature which is greater by a dew-point differential than the dew point of the treatment air, and controlling the volume rate of flow of the treatment air and the moisture content of the treatment air such that the mat is preheated to a predetermined temperature while liquid in the treatment air is allowed to condense in the mat to at most a maximum liquid content.

10 Claims, 3 Drawing Sheets

PREHEATING PARTICLES IN MANUFACTURE OF PRESSED BOARD

FIELD OF THE INVENTION

The present invention relates to the manufacture of pressed board. More particularly this invention concerns a method of preheating wood particles—fibers and chips—in the production of fiber or particle board.

BACKGROUND OF THE INVENTION

Particle board is typically made by depositing on a belt a thick mat of glue-coated particles, in the case of oriented strand board fibers between 75 mm and 150 mm long, preferably between 100 mm and 120 mm, and about 0.75 mm thick. The mat is then heated and pressed to the desired finished thickness. The pressing can be done continuously in an apparatus such as described in commonly owned U.S. Pat. No. 5,336,077 or in an intermittently operating platen-type press.

In order to minimize pressing time and, therefore, increase production efficiency while increasing the quality of the finished product, it is standard to preheat the mat before finish pressing it. German patent 1,276,912 describes how the mat is cut into sections and steam is used to heat the mat sections to the pressing temperature. To this end superheated steam at about 105° C. is used. The mat sections are loaded into the opened platen press which is subsequently closed. Then the sections are at first pressed without the application of steam to a smaller thickness than the desired finished thickness. Subsequently the platens of the press are heated by passing the superheated steam through a steam chamber connected to at least one of the platens which is formed with holes or pores so that the steam can get through to the mat section being pressed. Such a system produces a finished product that is frequently of less than the desired high quality.

Accordingly German patent document 3,640,682 describes how the particle mat is produced continuously and is prepressed somewhat by means of an unheated double-belt press before being preheated. The prepressed mats are then supported on a foraminous belt arranged above and below chambers into which a heated fluid, preferably superheated or saturated steam, is fed under pressure so that it soaks into and heats the mats. The heat transfer with this system is poor so that treatment time is fairly long.

In general it is hard to tailor the preheating with respect to the desired temperature and moisture content of the particles, different adhesives, and different parameters of the finished product. The main reason for this difficulty is that the fluid used for the preheating frequently has undesired side effects, that it is can change critical parameters of the particle mat in an undesired manner.

OBJECTS OF THE INVENTION

It is therefore an object of the present invention to provide an improved preheating method for the making of pressed board.

Another object is the provision of such an improved preheating method for the making of pressed board which overcomes the above-given disadvantages, that is which allows the preheating to be carried out in an exactly controlled manner.

SUMMARY OF THE INVENTION

According to this invention a particle mat for pressing into a pressed board is heated by concurrently passing through the mat treatment air coming from an air-conditioning system and having a predetermined moisture content and dew point, heating the treatment air passing through the mat to a temperature which is greater by a dew-point differential than the dew point of the treatment air, and controlling the volume rate of flow of the treatment air and the moisture content of the treatment air such that the mat is preheated to a predetermined temperature while liquid in the treatment air is allowed to condense in the mat to at most a maximum liquid content.

The temperature and moisture content of the prewarming treatment air are controlled as is standard in air-conditioning technology, normally by simply heating the treatment air while evaporating in it enough water to achieve the desired moisture content. The dew point of course is the temperature at which moisture will precipitate out of the treatment air stream, that is the temperature where with a given moisture content the relative humidity of the treatment air reaches 100%. The dew-point differential is a measurement of the moisture of the treatment air. It is the difference between the ambient treatment air temperature and the dew point. A large dew-point differential indicates a high saturation deficiency of the treatment air, that is relatively dry treatment air, and on the contrary a small dew-point differential indicates a higher moisture content, that is relatively humid treatment air. The moisture content here refers as is standard to the water-vapor content of the treatment air as relative humidity. With a relative humidity of 100% the treatment air is saturated with water vapor and excess water vapor will condense out.

The invention is based on the recognition that in the preheating of loose particulate matter in the production of pressed board the volume rate of flow of the treatment air, the dew point, and the dew-point differential (and also the treatment time) can be set without difficulty so that the predetermined preheating temperature for the preheated workpiece is attained. The concrete values are determined experimentally for the workpiece in question, whether glue-coated or not. The moisture content of the preheated workpiece can surprisingly be set very accurately when necessary as described below.

According to a feature of this invention the treatment air has a temperature above 90° C., preferably above 100° C. The treatment air has a relative humidity of less than 40%, preferably less than 30%. The condensation of the water vapor in the mat is at most 5%. The temperature of the treatment air is set so that it is at least 20°, preferably at least 30° above the temperature to which the mat is to be preheated. This avoids excess condensation in the workpiece.

According to the invention the moisture content and temperature of the treatment air are set by recirculating the treatment air after it traverses the mat through an air-conditioning plant.

In order to set the desired moisture content in the preheated mat there are several possibilities within the scope of the invention. The mat can be dried prior to passing the treatment air through it so as to reduce the mat's moisture content to compensate for the moisture subsequently regained by condensation from the treatment air passed through it. This drying can be effected by passing through the mat pretreatment air having the same dew point as the treatment air used to preheat it but having a higher dew-point differential. Alternately when the mat includes wood particles and an adhesive needing a predetermined water content for activation, the mat is dried prior to treatment to a lower water content than the content necessary for adhesive activation and the lacking water is condensed out of the treatment air as it is passed through the mat. Furthermore after prewarming the mat can be dried. When the pressed board is being made up of several layers, it is frequently only necessary to preheat the middle layer or layers.

In accordance with this invention the mat is continuously formed and is continuously passed through a preheating station where the method is carried out. The preheated mat is then passed through a belt-type continuous press for formation into the finished pressed board. Alternately the mat can be cut into sections that are preheated and subsequently loaded into a batch-type platen press or the like that works discontinuously, that is where the mat sections are stationary during the pressing operation.

The prewarming is done symmetrically, that there is a homogenous distribution of the preheating temperature over the thickness of the mat. In order to achieve this according to the invention the treatment air is passed vertically through the mat. More particularly the treatment air is introduced into the mat from above and from below. The treatment air can be applied simultaneously from above and below at a single location, or at a series of succeeding locations in a continuous process, or alternately from above, then from below. Normally immediately after the mat is prewarmed it is pressed.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
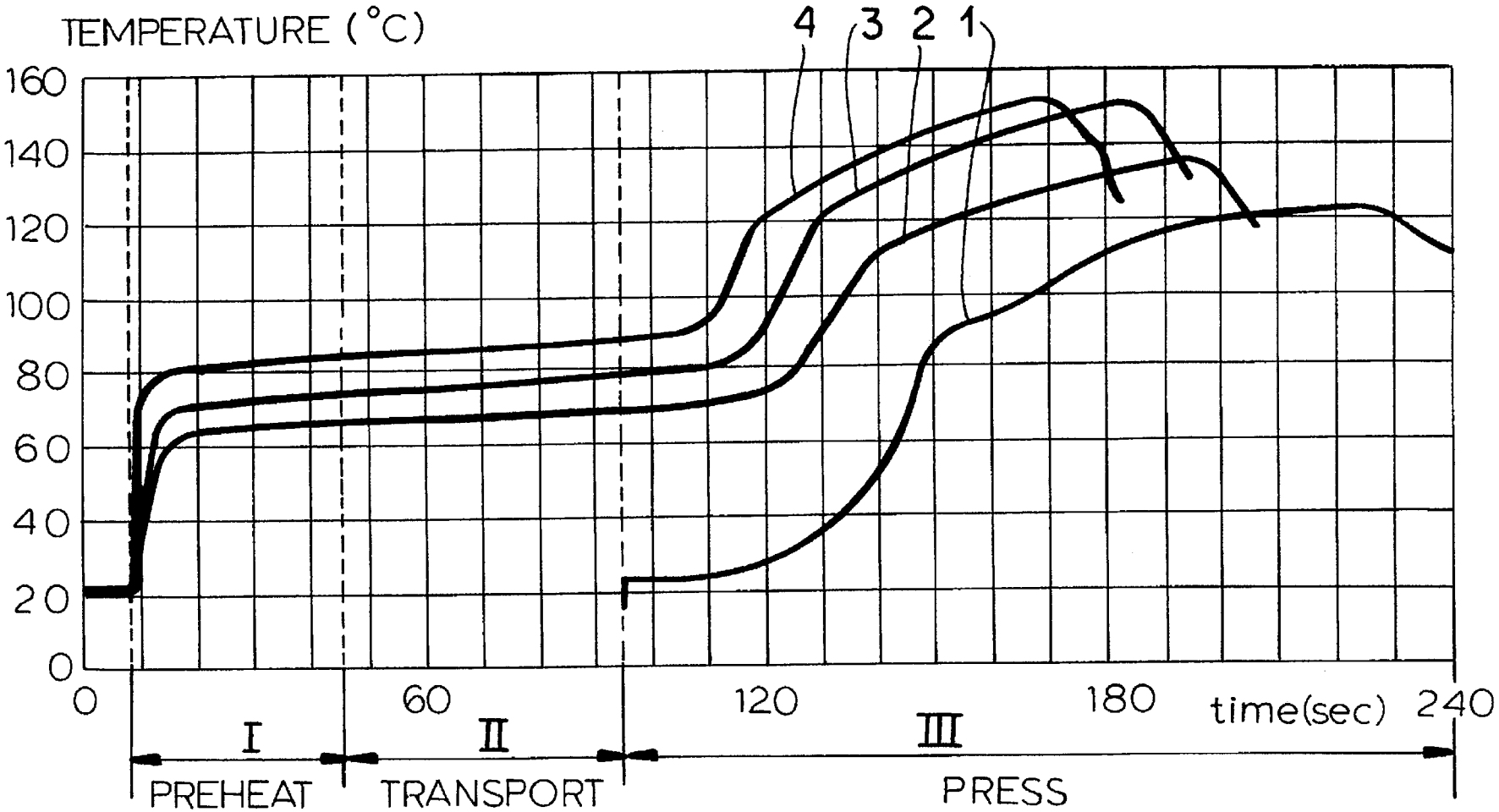
FIG. 1 is a graph illustrating the invention compared to the prior art in the production of oriented strand board.

FIG. 1 shows on the abscissa treatment time from 0 to 240 sec and on the ordinate temperature from 0° C. to 160° C. A glue and particle mat for production of oriented strand board 12 mm thick is heated in four different manners corresponding to curves 1, 2, 3, and 4. Section I is for preheating and is about 30 sec long, section II is transport to the press and is about 50 sec long, and section III represents the time in the press and is about 145 sec long.

Curve 1 represents the prior-art system with no preheating, so that it takes some 225 sec to heat the board to 122° C. Curve 2 shows preheating to 70° C., curve 3 to 80° C., and curve 4 to 90° C. The moisture content of the mat after prewarming is about 10%. Clearly curves 2 through 4 show that the desired temperature is reached much sooner with the preheating of this invention, so that in reality the press phase III can be stopped much sooner, thereby substantially increasing production speed since it is normally the press that constitutes the bottleneck in production. At 90° C. as indicated by curve 4, the preheating is at a rate or process factor of about 7 sec/mm.

The following table indicates the advantages of this invention:

Oriented strand board mat, finished thickness 12 mm

| | Unit | Not preheated | Preheated to 70° C. | Preheated to 90° C. |
|---|---|---|---|---|
| Process factor | sec/mm | 12 | 9 | 7 |
| Starting density | $kg/mm_3$ | 680 | 680 | 680 |
| Bending strength | $N/mm^2$ | 25.8 | 27.7 | 28.35 |
| Module of elasticity | $N/mm^2$ | 4140 | 4200 | 3930 |
| Transverse strength | $N/mm^2$ | 0.52 | 0.51 | 0.52 |
| 24-hr swelling | % | 25.4 | 23.3 | 21.35 |

If the thickness of the oriented strand board to be manufactured is different the quality parameters from the table are similar. The advantageous process factor of 7 sec/mm is the same with reheating to 90° C. The workpiece thickness can be as much as 60 mm.

Figure 2:
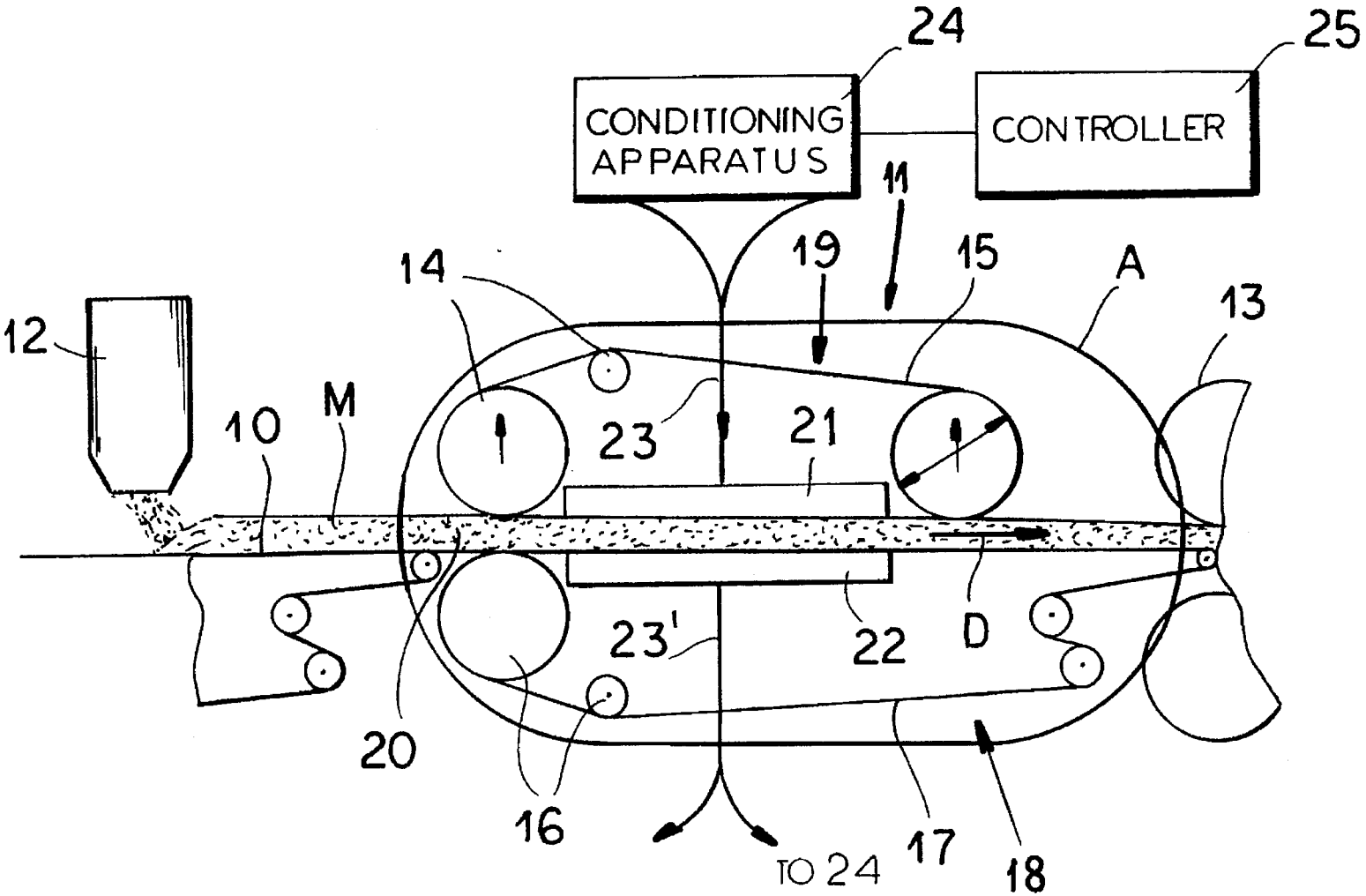
FIG. 2 is a largely schematic view illustrating an apparatus for carrying out the method of this invention.

The apparatus shown in FIG. 2 has an input conveyor belt 10 on which a mat M is formed by a particle-depositing hopper 12 so that it moves in a direction D through a prewarming machine 11 to a continuous belt-type press 13. Inside the prewarming apparatus 11 the mat M runs between lower and upper conveyor systems 18 and 19 having respective foraminous belts 17 and 15 spanned over rollers 16 and 14 and forming a passage or nip 20 between which the mat M may be compressed somewhat.

An air-conditioning apparatus 24 feeds humidified hot treatment air to an upper compartment 21 via a conduit 23 so it diffuses downward through the mat M. Underneath the mat M the treatment air is caught by another compartment 22 and fed via another conduit 23' back to the conditioning apparatus 24. A controller 25 connected to the apparatus 24 and to unillustrated sensors in the lines 23 operates the system.

Figure 3:
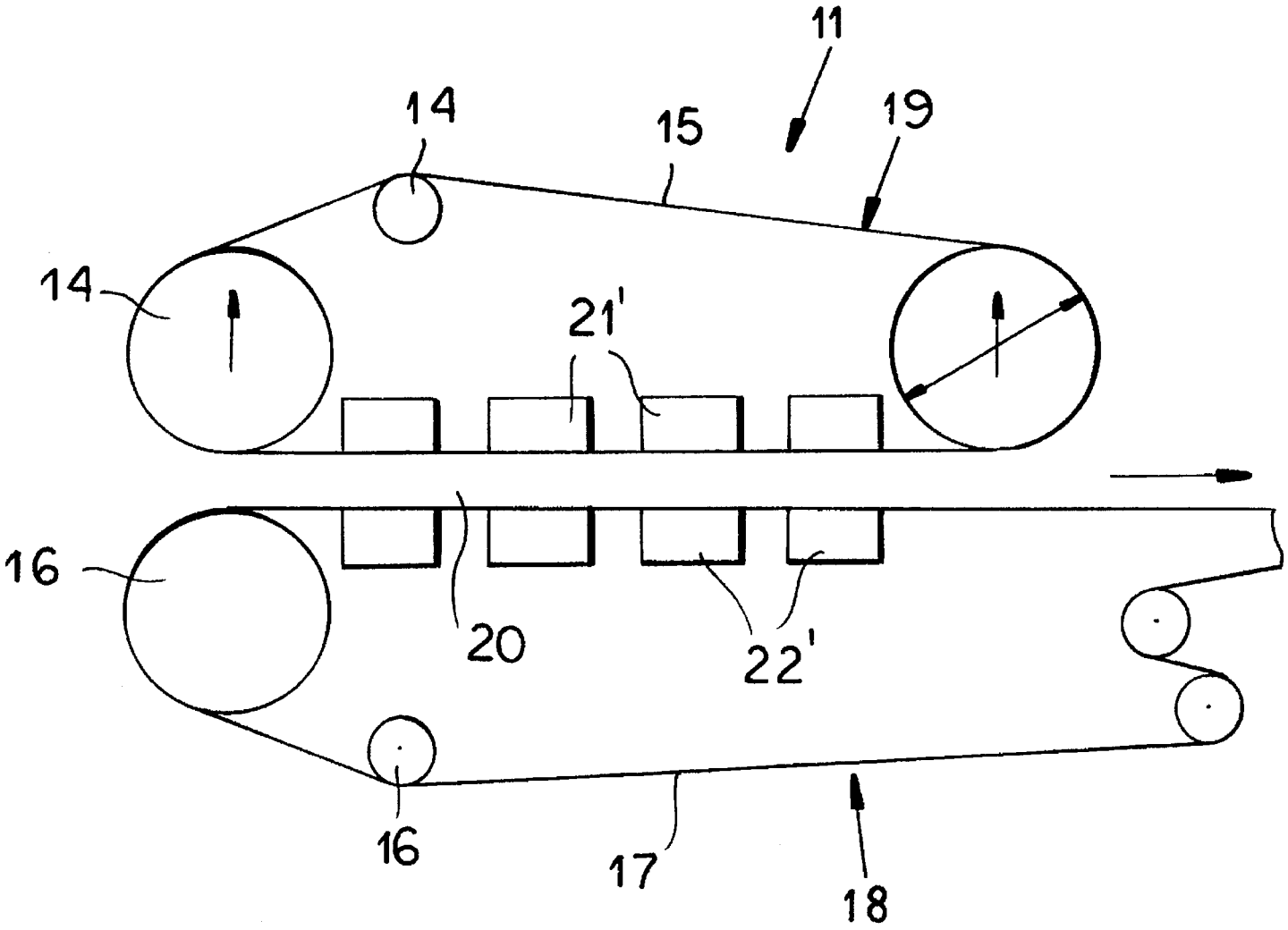
FIG. 3 is a schematic view illustrating an alternative apparatus.

In FIG. 3, where reference numerals from FIG. 2 are used for identical structure, the system is different in that it has four upper air-distribution boxes 21' and four respective lower boxes 22' spaced in the transport direction D. The direction of flow between the boxes 21' and 22' can be reversed with each succeeding pair of boxes and/or the temperature and/or humidity of the treatment air can vary from box pair to box pair.

We claim:

1. A method of preheating a particle mat for pressing into a pressed board, the method comprising the steps of:

passing through the mat air-conditioned treatment air having a predetermined moisture content and dew point;

heating the treatment air passing through the mat to a temperature which is greater by a dew-point differential than the dew point of the treatment air;

controlling the volume rate of flow of the treatment air and the moisture content of the treatment air such that the mat is preheated to a predetermined temperature while moisture in the treatment air is allowed to condense in the mat to at most a predetermined maximum moisture content; and drying the mat prior to passing the treatment air through the mat by passing through the mat pretreatment air having the same dew point as the treatment air used to preheat the mat but having a higher dew-point differential so as to reduce the mat's moisture content to compensate for the moisture subsequently regained by condensation from the treatment air passed through the mat.

2. The method defined in claim 1 wherein the treatment air has a temperature above 90° C.

3. The method defined in claim 1 wherein the treatment air has a temperature above 100° C.

4. The method defined in claim 1 wherein the treatment air has a relative humidity of less than 40%.

5. The method defined in claim 1 wherein the treatment air has a relative humidity of less than 30%.

6. The method defined in claim 1 wherein the moisture content and temperature of the treatment air are set by recirculating the treatment air after it traverses the mat through an air-conditioning plant.

7. The method defined in claim 1 wherein the mat includes wood particles and an adhesive needing a predetermined water content for activation, the mat having prior to treatment a lower water content than the predetermined content necessary for adhesive activation, the method further comprising the step of condensing sufficient water out of the treatment air as it is passed through the mat to activate the adhesive.

8. The method defined in claim 1 wherein the treatment air is passed through the mat in a preheating station and the mat is continuously formed and is continuously passed through the preheating station.

9. The method defined in claim 1 wherein the treatment air is passed vertically through the mat.

10. The method defined in claim 1 wherein the treatment air is introduced into the mat from above and from below.

* * * * *